US006024561A

United States Patent [19]

Kemp et al.

[11] Patent Number: 6,024,561

[45] Date of Patent: Feb. 15, 2000

[54] MONITORING FOR THE PRESENCE OF A FLAME IN A BURNER

[75] Inventors: Brendan Kemp, Bessels Green; Paul James Nichols, Bromley, both of United Kingdom

[73] Assignee: Autoflame Engineering Limited, United Kingdom

[21] Appl. No.: 09/234,391

[22] Filed: Jan. 20, 1999

[51] Int. Cl.[7] ..... F23N 5/08

[52] U.S. Cl. ..... 431/79

[58] Field of Search ..... 431/79

[56] References Cited

U.S. PATENT DOCUMENTS 5,077,550 12/1991 Cormier ..... 431/79
5,256,057 10/1993 Grow ..... 431/79

FOREIGN PATENT DOCUMENTS 1 573 659 8/1980 United Kingdom .
2 138 610A 10/1984 United Kingdom .
2 169 726B 7/1986 United Kingdom .

*Primary Examiner*—Carroll Dority
*Attorney, Agent, or Firm*—Merchant & Gould, P.C.

[57] ABSTRACT

A method of monitoring for the presence of a flame in a burner includes the steps of providing a UV bulb sensor (1) whose electrical output signal in response to a voltage applied across the sensor varies according to the presence or absence of UV light radiating from a burner flame, connecting the sensor across a voltage source (2) which is adjustable, the voltage source being set at a first setting, and monitoring the output signal from the bulb sensor during operation of the burner and automatically altering the setting of the voltage source from the first setting in accordance with the monitored output signal to maintain the output signal within a predetermined range.

13 Claims, 2 Drawing Sheets

MONITORING FOR THE PRESENCE OF A FLAME IN A BURNER

The present invention relates to a method of monitoring for the presence of a flame in a burner, to a burner flame monitoring device and to a burner control installation including such a device.

In order to monitor for the presence of a flame in a burner it is known to provide a sensor, which is commonly an ultraviolet (UV) bulb sensor to check for the presence of a flame. The same sensor may be used to check for both the presence of the main flame and the presence of the pilot flame.

A conventional bulb sensor operates by applying a voltage, typically in the United Kingdom an alternating voltage of 300V peak (230V is the RMS value) a.c. across filaments of the bulb, which is filled with inert gas. In the presence of UV light discharges occur between the filaments, each discharge resulting in a small pulse of current. The currents from the bulb are passed through a filter circuit, which may simply comprise a resistor and capacitor in series, are amplified and then passed across the coil of a relay to hold it in, (the "in" state being the opposite state to that adopted in the absence of any current). Thus while the small currents recur sufficiently frequently their integrated effect is to hold the relay in all the time. The capacitor, amplifier and relay coil together act as a storage buffer damping the response so that momentary intervals between pulses of current do not trigger a "no flame detected" signal. If, however, there is a continued absence of current pulses, the relay is released and a "no flame detected" signal generated.

In order to provide a more dynamic response it is advantageous to monitor the individual pulses of current. In one particular proposal a voltage of 300V DC is applied cyclically across a bulb; for example the voltage may be applied for 20 ms and then left off for 60 ms. The number of current pulses detected over, say, three cycles may then be monitored and that number (the "count") used as an output signal from the sensor. In such an arrangement the operation has proved effective for monitoring a main flame but was not always effective when required to monitor a pilot flame especially if the locations of the pilot flame and bulb sensor were not ideally suited to one another.

A possible approach to solving that problem would be to increase the period for which the voltage is applied so that, say, in one cycle the voltage was applied for 60 ms and left off for 20 ms. We have found, however, that whilst that approach may appear to work and does increase the count it can give rise to a more serious problem, namely that after a considerable period of operation the bulb sensor may become damaged and, as a result, a count may still be present indicating the presence of a flame, even when no flame exists. That is of course a very serious matter.

An object of the invention is to provide a method of monitoring for the presence of a flame in a burner, and a burner flame monitoring device, which avoids or mitigates the problems of the methods described above and which in particular is able to provide for a prolonged period a reliable indication of the presence of both a burner main flame and a burner pilot flame.

According to the invention there is provided a method of monitoring for the presence of a flame in a burner, the method including the following steps:

providing a UV bulb sensor whose electrical output signal in response to a voltage applied across the sensor varies according to the presence or absence of UV light radiating from a burner flame, the sensor being disposed at a location exposed to UV light from the flame of the burner, connecting the bulb sensor across a voltage source which is adjustable, the voltage source being set at a first setting, monitoring the output signal from the bulb sensor during operation of the burner and automatically altering the setting of the voltage source from the first setting in accordance with the monitored output signal to maintain the output signal within a predetermined range.

The automatic alteration of the setting of the voltage source enables automatic adjustment of the sensitivity of the monitoring according to the output signal. Thus if for example a small pilot flame is being monitored and the output signal from the bulb sensor is therefore less than the predetermined range, the voltage setting is increased until the output signal falls within the predetermined range. If the main flame is then lit and the output from the bulb sensor therefore increases substantially and moves above the predetermined range, then the voltage setting is reduced until the output signal drops back to lie within the predetermined range. Such a procedure enables good and reliable monitoring for the presence of a flame of any size to be achieved and prolongs the life of the bulb sensor.

The alteration of the setting of the voltage source may take various forms. For example the magnitude of the peak voltage applied may be altered, but preferably the voltage source across which the bulb sensor is connected is a source of pulses of DC voltage and the setting of the voltage source is altered by altering the duration of each of the pulses. Preferably the magnitude of the DC voltage of each pulse remains substantially the same when the duration of the pulse is altered. The pulses preferably last for between 10 and 100 ms and occur at a frequency of between 10 and 100 Hz. Preferably the frequency of the pulses remains constant when their duration changes.

In the event that the output signal from the bulb sensor is below the predetermined range, the duration of each of the pulses is preferably increased by a first predetermined length of time and in the event that the output signal from the bulb sensor is above the predetermined range the duration of each of the pulses is preferably reduced by a second predetermined length of time. The first and second predetermined lengths of time may conveniently be the same. It will be understood that, taking for example the case where the output signal is below the predetermined range and the duration of each of the pulses is therefore increased by the first predetermined length of time, the increase may not be sufficient to bring the output signal within the predetermined range; in that case the duration of each of the pulses is increased again by the first predetermined length of time and that increase is repeated until the output signal falls within the predetermined range. In an embodiment of the invention described below the first and second predetermined lengths of time are each 1 ms.

The voltage source is preferably set initially at its maximum setting and then reduced in steps until the output signal from the bulb sensor lies within the predetermined range. By commencing operation at the maximum setting of the voltage source, effective operation of the bulb sensor at the outset is ensured and the life of the sensor not significantly affected because the setting of the voltage source is quickly reduced until the output from the bulb sensor lies within the predetermined range.

The bulb sensor is preferably of entirely conventional design. An example of a suitable bulb sensor is one manufactured by Sylvania GmbH; such a bulb sensor generates a series of pulses of current in the presence of the applied voltage and UV light. The number of current pulses generated in a given time by the sensor is preferably used in the present invention as the output signal from the sensor. In a typical conventional case, a sensor bulb provides a count of between 50 and 200 for a period of 250 ms. In accordance with the present invention, the sensor bulb is preferably arranged to provide a relatively low count during stable operation and the high end of the predetermined range of the output signal from the bulb sensor is preferably a count of less than 0.5 $ms^{-1}$. Thus over a period of 250 ms the count representing the maximum end of the predetermined range is preferably less than 125. Preferably the high limit of the predetermined range is substantially lower than this, thereby further prolonging bulb life; more particularly, the maximum count within the predetermined range is preferably less than 60 during a 250 ms period. In an embodiment of the invention described below the predetermined range is 20 to 30 counts over a 250 ms period.

The monitoring procedure of the invention may be employed only to monitor the main flame of a burner or only to monitor the pilot flame of a burner but its ability to adjust automatically makes it especially advantageous when the bulb sensor operates both when only a pilot flame of the burner is alight and when the burner is operating at maximum heat output.

According to the invention there is also provided a burner flame monitoring device comprising

- a UV bulb sensor whose electrical output signal in response to a voltage applied across the sensor varies according to the presence or absence of UV light radiating from a burner flame,
- a voltage source whose setting is adjustable and which is connected across the bulb sensor, and
- a monitoring system for monitoring the output signal from the bulb sensor during operation of the burner and automatically altering the setting of the voltage source in accordance with the monitored output signal to maintain the output signal within a predetermined range.

According to the invention there is still further provided a burner control installation including

- a burner for burning fuel,
- a control unit for controlling the flow of fuel and air to the burner, and
- a burner flame monitoring device comprising a UV bulb sensor whose electrical output signal in response to a voltage applied across the sensor varies according to the presence or absence of UV light radiating from a burner flame, and a voltage source whose setting is adjustable and which is connected across the bulb sensor, the bulb sensor being disposed at a location exposed to UV light from the flame of the burner,
- wherein the control unit is arranged to monitor the output signal from the bulb sensor during operation of the burner and automatically to alter the setting of the voltage source in accordance with the monitored output signal to maintain the output signal within a predetermined range.

It should be understood that the burner flame monitoring device and the burner control installation may include the necessary structural features to make them suitable for carrying out the method of the invention in any of the forms defined above.

By way of example an embodiment of the invention will now be described with reference to the accompanying drawings, of which:

Figure 1:
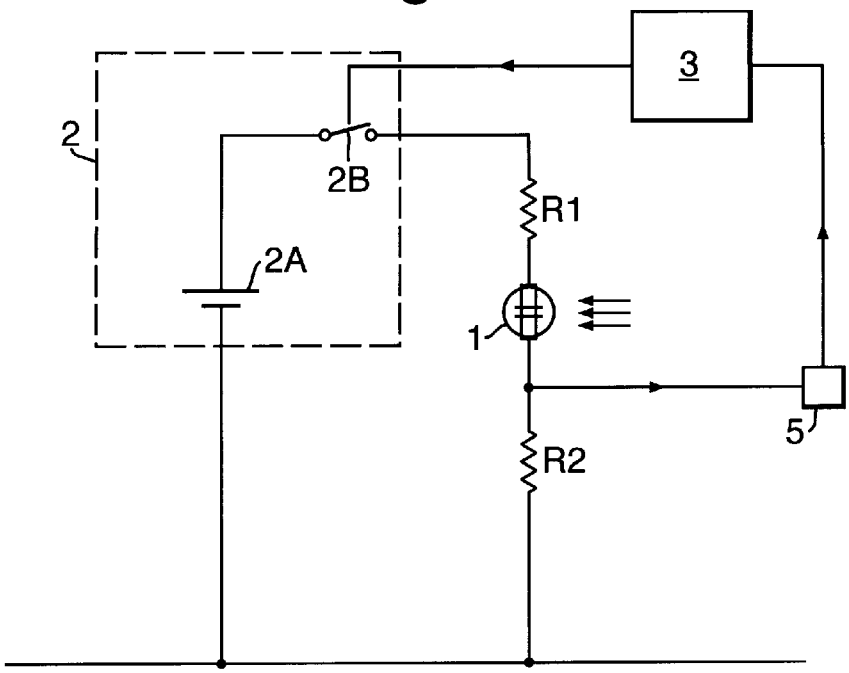
FIG. 1 is a circuit diagram of a burner flame monitoring device.

Referring firstly to FIG. 1, a burner flame monitoring device shown therein generally comprises a UV bulb sensor 1, a source 2 of DC voltage, a microprocessor 3 which is connected to receive an output signal from the UV bulb sensor 1, via a counter 5 and resistors R1 and R2. The source 2 of DC voltage comprises a DC voltage supply 2A and an electronic switch 2B.

The UV bulb sensor 1 is of a form that is well known. Various companies such as Sylvania GmbH in Germany and the Japanese company known as Hamamatsu manufacture suitable sensors which are already used to monitor for flame failure in burners. One example of a suitable commercially available product is the Photodetector Type No. P630 currently sold by Sylvania GmbH. The bulb sensor 1 is positioned in the burner (not shown) in a conventional manner with the sensor exposed to UV light from both the main burner flame and the pilot flame.

Typically, when used in a burner flame scanning device, the bulb sensor 1 is connected to a source of alternating voltage, typically of 230V R.M.S. and 300V peak, and the output signal from the bulb is connected to a filter circuit, amplifier and relay, as described above. In the presence of UV light an output signal is generated and the cumulative effect of that signal is sufficient that when amplified it holds the relay "in" thereby indicating the presence of a flame.

The arrangement embodying the invention and shown in FIG. 1 uses the same bulb sensor 1 but differs from the typical arrangement in two respects as will now be described.

Figure 2:
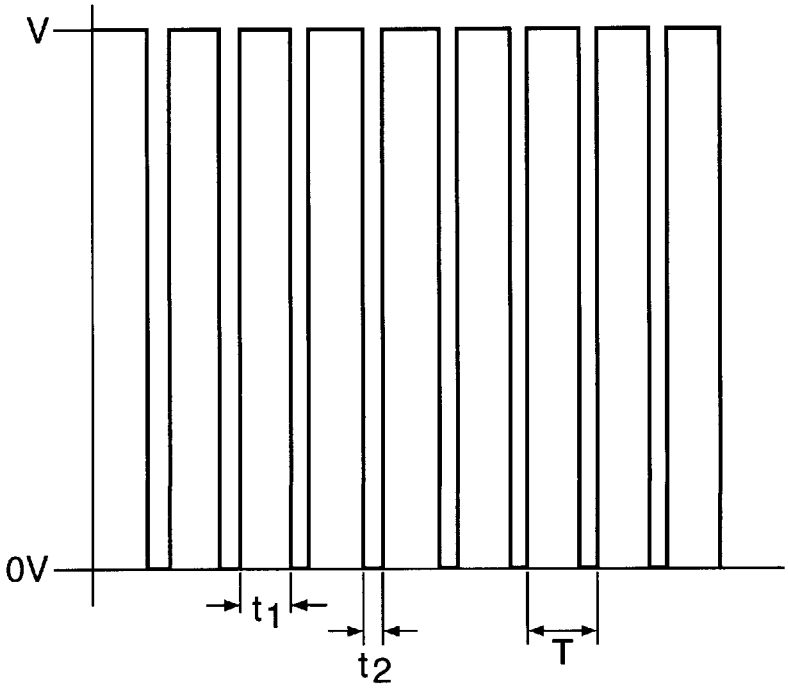
FIG. 2 is a graph showing the voltage signal provided by a voltage source forming part of the monitoring device of FIG. 1.

Firstly, instead of employing an alternating source of voltage, the voltage source 2 provides, by virtue of the electronic switch 2B, pulses of DC voltage in cycles as illustrated in FIG. 2. Referring to FIG. 2 it will be seen that in the course of a cycle of duration T, the DC voltage is applied at a level V for a time $t_1$ and is then turned off for a time $t_2$. In a particular example of the invention the value of V is 300V and the value of T is 80 ms. In this example the value of R1 is 400 kΩ and the value of R2 is 10 kΩ. The times $t_1$ and $t_2$ when combined together are of course 80 ms but the individual values of $t_1$ and $t_2$ are varied in accordance with a control signal received by the electronic switch 2B from the microprocessor 3, as will be described in more detail later.

The second way in which the arrangement of FIG. 1 differs from a typical prior arrangement is in the treatment of the output signal from the bulb sensor 1. The output signal from the bulb sensor, in the presence of UV light, comprises a series of current pulses; in a conventional system, it is the cumulative effect of the current pulses that is used to hold a relay "in" whereas in the embodiment of the invention shown in FIG. 1 the individual current pulses are detected and counted by the counter 5 and the result passed to the microprocessor 3. The number of such current pulses should be zero but in any case will be very small in the absence of UV light, even with an applied voltage of 300V DC, but in the presence of UV light the number increases substantially and thus the number of pulses detected in a given period by the counter 5 (referred to herein as the "count") provides a rapid indication of the presence or absence of UV light. In a particular example of the invention the count is measured over a period of 250 ms (corresponding to about 3 cycles of the voltage source 2) so that a count of 30 represents 30 pulses of current over a period of 250 ms.

The count increases if the voltage level is in some sense increased (for example by increasing the time $t_1$ compared to the time $t_2$, or by increasing the magnitude V of the voltage) and also if the amount of UV light incident on the bulb sensor 1 increases. During operation of the burner, the amount of UV light varies as a result of the burner being run at a low or high setting and an even wider variation occurs between the case where only a pilot flame of the burner is alight and the case where the main flame of the burner is at its maximum setting. We have found that although in principle the bulb sensor 1 is able to detect the presence of such a wide variety of flames, there is a problem that if the sensor 1 is connected in a circuit with sufficient sensitivity to detect the pilot flame, the count when the main flame is burning at its maximum setting becomes very high; we have found that such very high counts substantially shorten the life of the bulb sensor 1. In the described embodiment of the invention this problem is overcome by varying the setting of the voltage source 2 during operation as will now be described.

In order to explain the operation of the invention it is convenient to provide a particular example with associated numerical values and that approach is followed below, but it will be understood that the actual values chosen may be varied to suit the particular circumstances of a given situation.

At the commencement of operation the microprocessor 3 sets the voltage source 2 to produce a cyclical DC voltage of the form shown in FIG. 2 with the value of V at 300V (which value remains constant throughout the operation of the burner) and with the time $t_1$ set at 60 ms and the time $t_2$ set at 20 ms. At the outset a user also selects a threshold value for the minimum count that is to be regarded as an indication of the presence of a flame; in this particular example this will be assumed to be 10 (i.e. 10 current pulses within, in this example, a sampling period of 250 ms). The microprocessor then sets the range of output signal from the probe that is to be accepted; in this example the range is a count of between 20 and 30.

The initial voltage cycle of FIG. 2 represents the maximum level of voltage that is applied across the bulb and therefore, even with only the pilot flame burning, the count from the bulb sensor 1 monitored by the microprocessor 3 is likely to be greater than 30. Consequently, because the signal is above the predetermined range, the microprocessor adjusts the voltage source 2 by reducing the time $t_1$ and increasing the time $t_2$. In this particular example the adjustment is a change of 1 ms so that the duration ($t_1$) of voltage application becomes 59 ms and the duration ($t_2$) of the voltage being off becomes 21 ms. After 4 cycles, that is after one second, in this example, the count from the bulb sensor 1 is again monitored; if it has fallen to a value within the predetermined range of 20 to 30, then the voltage source is maintained at its new setting but if it is still above the predetermined range, the voltage source is again adjusted by changing the times $t_1$ and $t_2$ by 1 ms; those steps are repeated each second until the signal from the bulb sensor 1 falls within the desired range of a count of 20 to 30.

If, for example, the main flame of the burner is turned off leaving only the pilot flame to provide UV light, then the signal from the bulb sensor 1 is likely to fall below the bottom limit of the predetermined range (i.e. below 20). In that case the voltage source 2 is adjusted by increasing the time $t_1$ and reducing the time $t_2$ in steps of 1 ms until the count rises to within the predetermined range. In the event that the voltage source 2 reaches its maximum setting and the count has still not reached 20, that is regarded by the microprocessor 3 as an indication of there being no flame and the appropriate control steps, including shutting down of the fuel supply to the burner, are executed.

Thus it will be seen that with the arrangement embodying the invention, the monitoring system is continually adjusted so that failure of even the pilot flame can be reliably detected, yet the bulb sensor 1 is not overloaded for a prolonged period of time and therefore its life is prolonged.

Figure 3:
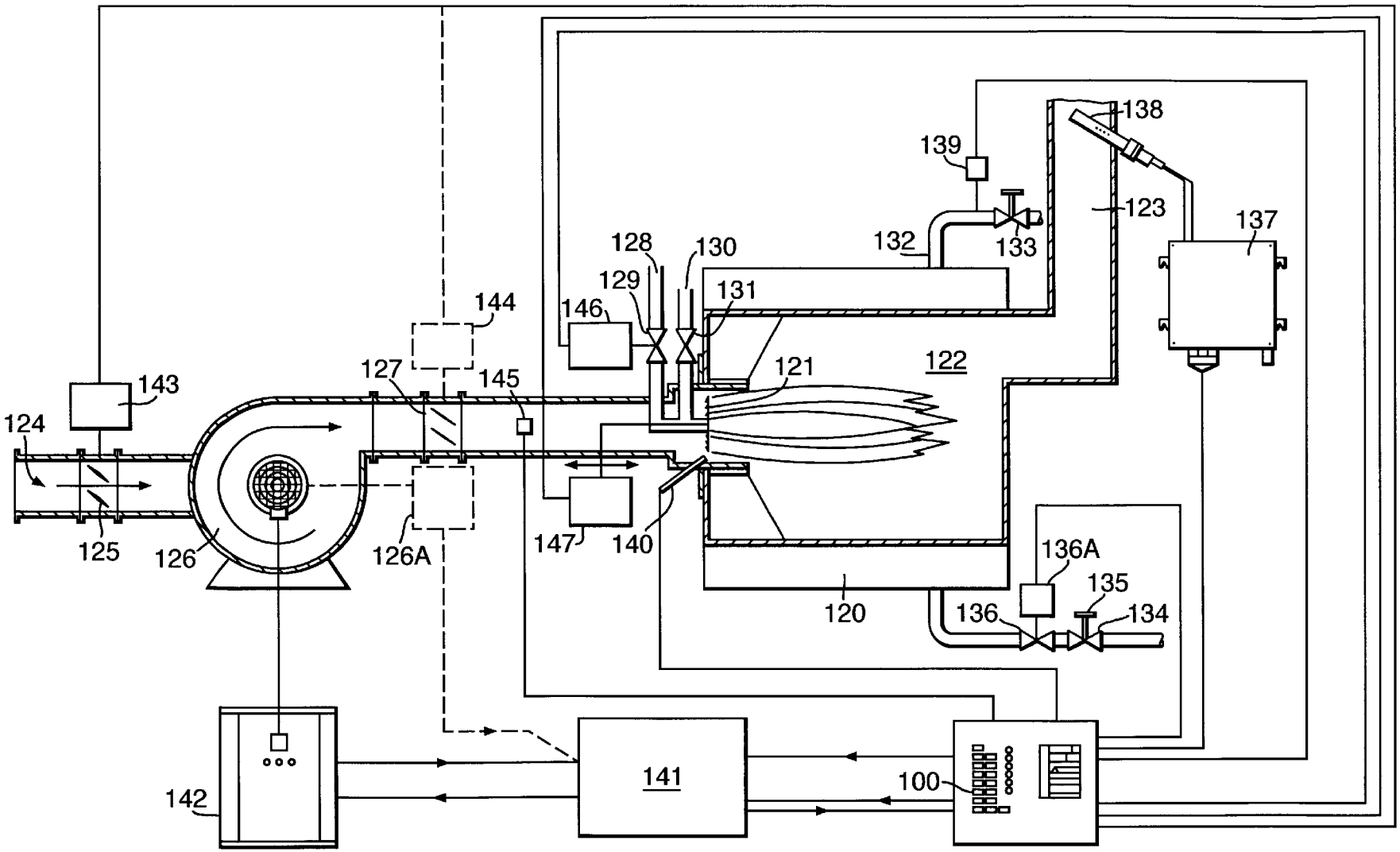
FIG. 3 is a diagram of a boiler installation including the burner flame monitoring device of FIG. 1.

FIG. 3 shows a particular example of how the flame monitoring device of FIG. 1 may be employed in a boiler installation. The boiler installation includes a control unit 100 for a fuel burner of a boiler. Control units of this general kind are well known and are commercially available; for example there are the Micro Modulation control systems of Autoflame Engineering Limited. GB 2,138,610 B and GB 2,169,726 B are concerned with inventions relating to such control units and the disclosures of both those patent specifications are incorporated herein by reference.

In general terms, the burner control unit 100 provides output control signals to a motor for operating a fuel valve and a motor for operating an air valve to control the amounts of fuel and air flowing to the burner. The control unit 100 also receives input signals comprising for example signals from sensors which detect the positions of valve members of the air and fuel valves, one or more signals from sensors detecting variables relating to the products of combustion and a signal indicating the temperature of water in the boiler. In operation the control unit receives the temperature input signal, compares it with a desired value and according to the difference in the two values adjusts the air and fuel valves to alter the rate of combustion of the boiler. Signals relating to the products of combustion are also received by the control unit and may be used to make adjustments to the ratio of air and fuel supplied to the burner, as more fully described in GB 2,169,726 B.

In order for the burner control unit 100 to operate effectively in use with a particular burner installation it must be commissioned. In the case of the burner control unit 100 of GB 2,138,610 B such commissioning includes, amongst other steps, selecting and storing pairs of output control signals for the air and fuel valves at different levels of output of the burner so as to optimize the combustion process throughout the whole operational range of the burner. When the control unit 100 is subsequently operating it compares an input signal indicating the temperature of water in the boiler with stored data indicating a desired temperature and, according to the difference, selects a level of output for the burner. The control unit is then able to determine appropriate positions for the air and fuel valve members and to adjust the members as necessary, taking account also of input signals relating to the products of combustion and any other inputs that the control unit may receive.

During both the commissioning operation and during subsequent running of the boiler, it is desirable for an operator to be able to read data from the control unit 100 and for this purpose the control unit 100 is provided with a display on its front face.

Referring now specifically to the particular example of the boiler installation shown in FIG. 3, the installation comprises a boiler 120 including a burner head 121, a combustion chamber 122 and a flue 123. Air is fed to the burner head 121 from an air inlet 124, via an air inlet damper 125 through a centrifugal fan 126 and, finally, an air outlet damper 127. Usually only one or other of the dampers 125 and 127 is provided. The burner head 121 is able to operate with either gas or oil as the fuel; gas is fed to the burner head from an inlet 128 via a valve 129 whilst oil is fed to the burner head from an inlet 130 via a valve 131. The boiler has a water outlet pipe 132 with a manually-operated valve 133 and a water return pipe 134 with a conventional manually-operated valve 135 and an additional valve 136.

The control unit 100 is connected to various sensing devices as shown in FIG. 3. More particularly the unit is connected via an exhaust gas analyser 137 to an exhaust gas analysis probe 138 and to a load sensor (temperature sensing device) 139 monitoring the water outlet of the boiler. The control unit 100 is also connected via an inverter interface unit 141 and an inverter 142 to the motor of the fan 126 (with interface unit 141 receiving a feed back signal from a tachometer 126A associated with the fan 126), via a first air servo motor 143 to the air inlet damper 125 and/or via a second air servo motor 144 to the air outlet damper 127, to an air pressure sensing device 145 provided in the air supply duct downstream of the outlet damper 127, via fuel servo motors 146 to the fuel valves 129, 131, to a further servo motor 147 for adjusting the configuration of the burner head 121, and to a control unit 136A for the valve 136 on the water return pipe 134 to the boiler. The control unit 100 performs all the control functions for the burner unit, including the functions that would conventionally be carried out by a separate control box (for example the control of the burner during the ignition phase).

In addition the control unit 100 is connected to a flame monitor 140 which incorporates the sensor bulb 1 described above. The monitor 140 is positioned with the bulb exposed to the base of the burner flame and to the pilot flame (not shown). The monitor 140 is connected to the control unit 100 which incorporates the other components of the flame monitoring device shown in FIG. 1. The microprocessor 3 of the flame monitoring device is also the microprocessor used for the other control operations carried out by the control unit 100. The control unit 100 checks that the signal from the device 140 is indicating the presence of a flame and, if it is not, then a fault is indicated and the control unit generates an alarm and/or shuts down the system.

Whilst the invention has been described above with reference to a particular form of burner control unit, it should be understood that the invention can be applied to any of a wide variety of burner control units performing all or only some of the burner controlling functions referred to above.

We claim:

1. A method of monitoring for the presence of a flame in a burner, the method including the following steps:

providing a UV bulb sensor whose electrical output signal in response to a voltage applied across the sensor varies according to the presence or absence of UV light radiating from a burner flame, the sensor being disposed at a location exposed to UV light from the flame of the burner, connecting the bulb sensor across a voltage source which is adjustable, the voltage source being set at a first setting, monitoring the output signal from the bulb sensor during operation of the burner and automatically altering the setting of the voltage source from the first setting in accordance with the monitored output signal to maintain the output signal within a predetermined range.

2. A method according to claim 1, in which the voltage source across which the bulb sensor is connected is a source of pulses of DC voltage and the setting of the voltage source is altered by altering the duration of each of the pulses.

3. A method according to claim 2, in which the magnitude of the DC voltage of each pulse remains substantially the same when the duration of the pulse is altered.

4. A method according to claim 2, in which in the event that the output signal from the bulb sensor is below the predetermined range the duration of each of the pulses is increased by a first predetermined length of time and in the event that the output signal from the bulb sensor is above the predetermined range the duration of each of the pulses is reduced by a second predetermined length of time.

5. A method according to claim 1, in which the voltage source is initially set at its maximum setting and is then reduced in steps until the output signal from the bulb sensor lies within the predetermined range.

6. A method according to claim 1, in which the bulb sensor generates a series of pulses of current in the presence of the applied voltage of UV light, and the number of current pulses generated in a given time by the sensor represents the output signal from the sensor.

7. A method according to claim 1 in which the bulb sensor operates both when only a pilot flame of the burner is alight and when the burner is operating at maximum heat output.

8. A method according to claim 3, in which in the event that the output signal from the bulb sensor is below the predetermined range the duration of each of the pulses is increased by a first predetermined length of time and in the event that the output signal from the bulb sensor is above the predetermined range the duration of each of the pulses is reduced by a second predetermined length of time.

9. A burner flame monitoring device comprising a UV bulb sensor whose electrical output signal in response to a voltage applied across the sensor varies according to the presence or absence of UV light radiating from a burner flame, a voltage source whose setting is adjustable and which is connected across the bulb sensor, and a monitoring system for monitoring the output signal from the bulb sensor during operation of the burner and automatically altering the setting of the voltage source in accordance with the monitored output signal to maintain the output signal within a predetermined range.

10. A device according to claim 9, in which the voltage source across which the bulb sensor is connected is a source of pulses of DC voltage and the setting of the voltage source is arranged to be altered by altering the duration of each of the pulses.

11. A device, according to claim 10, in which the bulb sensor is arranged to generate a series of pulses of current in the presence of an applied voltage and UV light, and the number of current pulses generated in a given time by the sensor represents the output signal from the sensor.

12. A device according to claim 9, in which the bulb sensor is arranged to generate a series of pulses of current in the presence of an applied voltage and UV light, and the number of current pulses generated in a given time by the sensor represents the output signal from the sensor.

13. A burner control installation including a burner for burning fuel, a control unit for controlling the flow of fuel and air to the burner, and a burner flame monitoring device comprising a UV bulb sensor whose electrical output signal in response to a voltage applied across the sensor varies according to the presence or absence of UV light radiating from a burner flame, and a voltage source whose setting is adjustable and which is connected across the bulb sensor, the bulb sensor being disposed at a location exposed to UV light from the flame of the burner, wherein the control unit is arranged to monitor the output signal from the bulb sensor during operation of the burner and automatically to alter the setting of the voltage source in accordance with the monitored output signal to maintain the output signal within a predetermined range.

* * * * *